United States Patent [19]

Anderson

[11] 4,297,818

[45] Nov. 3, 1981

[54] ROOF VENTILATING LOUVER

[75] Inventor: William J. Anderson, Taylorsville, Miss.

[73] Assignee: Anderson Metal Products Corp., Taylorsville, Miss.

[21] Appl. No.: 134,694

[22] Filed: Mar. 27, 1980

[51] Int. Cl.[3] ..... E04B 2/00

[52] U.S. Cl. ..... 52/199; 98/42 A

[58] Field of Search ..... 52/199, 200; 98/42 R, 98/42 A

[56] References Cited

U.S. PATENT DOCUMENTS

| | | | |
|---|---|---|---|
| 3,093,059 | 6/1963 | Metz | 98/42 |
| 3,094,915 | 6/1963 | Leigh | 98/42 |
| 3,520,245 | 7/1970 | Panter | 52/200 X |
| 3,579,930 | 5/1971 | Murphy | 98/42 X |
| 3,895,467 | 7/1975 | Clement | 98/42 X |
| 4,050,363 | 9/1977 | Fuerst | 98/42 R |

FOREIGN PATENT DOCUMENTS

| | | | |
|---|---|---|---|
| 1347247 | 2/1974 | United Kingdom | 98/42 |

*Primary Examiner*—Carl D. Friedman

*Attorney, Agent, or Firm*—Darbo & Vandenburgh

[57] ABSTRACT

A roof ventilating louver incorporates a unique slope design which precludes accumulation of snow and ice above the louver, preventing drippage through the louver and permitting a low profile as compared with other roof louvers. The louver is manufactured in separate base and cover pieces to ease installation and permit periodic inspection of the screen and ventilation opening. Pilot posts and openings are specifically designed for the slope and act as a hinge to provide simple yet assured orientation of the cover with the base when assembling the unit. The spacing of screen posts and fastener posts is coordinated with the size and pattern of the screen mesh openings to eliminate the necessity of preforming post holes in the screen. These novel design features minimize cost of manufacture, ease installation and improve operation.

8 Claims, 7 Drawing Figures

32b
54
66
40
32a
55
56
28
66
48

26
18
32
32b
32a
38
56
32a
66
46a
36
28
40
44
48
52
16
66
36
66
27
48
46a
28
25
50
46b
66
20
34
44
42
52
52
26
18
24

ROOF VENTILATING LOUVER

BACKGROUND AND SUMMARY OF THE INVENTION

There are many types and designs of roof ventilating louvers used in both residential and business construction. Ventilating louvers permit passage of air out of the attic area to avoid excessive build up of heat and moisture, while at the same time preventing, with varying degrees of success, entry of precipitation from the atmosphere and roof into the building.

Many ventilating louvers attempt to prevent snow on the roof from entering the louver and hence from dripping into the attic area by extending the louver substantially above the roof itself. Such louvers are unsightly, expensive, and most importantly do not solve the problem when there is a heavy accumulation of snow on the roof.

Many louvers are designed with a cover which overlaps the ventilation opening in the louver base, thus preventing rain from entering the louver. During periods of snow accumulation, air warmer than the atmosphere exits through the louver, thus melting a small area of snow around the louver and permitting continued function of the ventilating louver. However, due to the sloping roof, snow tends to accumulate especially against the roof-apex side of the louver. Snow melting on this side of the louver easily drips into the louver itself once melted by the warm air escaping from the attic or when melted by warmer atmospheric conditions. Once snow has accumulated on the roof, the drippage inside the louver may be continuous. As the snow on the roof-apex side of the louver melts and drips through the louver, more snow may slide down the roof into the same position against the louver, or else collect there due to various wind conditions.

Roof louvers should be designed so as to allow one to clear the ventilation opening and the covering screen in the event of clogging from leaves or other debris. Also, the condition of the screen itself should be inspected periodically for unusually large holes caused by age or animals. The screen prevents animals and debris from entering the attic area.

Having a ventilation opening protected from the elements and a screen covering permitting periodic inspection cause increased cost in manufacture of louvers attempting to meet these design specifications.

The present invention provides for a louver which projects only slightly from the roof as compared with most other louvers, while at the same time enhancing protection from precipitation drippage through the ventilation opening by providing a unique slope portion on both the base and cover of the louver on the roof-apex side of each. The slope portions on the base and cover fit together to form a substantially continuous surface on the high side of the louver when installed on a sloping roof. Snow accumulation above the louver is thus prevented from entering the louver and causing drippage.

The sloping portion of the louver lends itself to the use of pilot posts and pilot holes designed for simple and time saving installation of the cover onto the base, allowing the installer to easily guide the cover into position over the base after the latter has been fastened down. The pilot posts and pilot holes together act as a hinge to first mutually orient the cover and base and then permit lowering of the cover into assured inter-fitting orientation with the base.

The cover of the present invention is removably secured to the base, allowing cleaning of the louver and inspection of the screen. The present invention also coordinates the size and pattern of the screen mesh openings with the size and location of the screen posts and fastener posts on the base, thereby permitting assembly of the louver in a way which eliminates the necessity of additional preformed post holes in the screen. The screen is secured to the base by the screen posts themselves, thus eliminating additional fasteners. These design features reduce the cost of manufacture.

The use of the novel screen fastening means and the design features provided by the slope portion and pilot posts and the molding of all posts integrally with the part to which it is permanently secured allow the base and cover to be inexpensively manufactured of molded plastic material, further reducing cost and improving appearance.

DESCRIPTION OF EXAMPLE EMBODYING BEST MODE OF THE INVENTION

Figure 1:
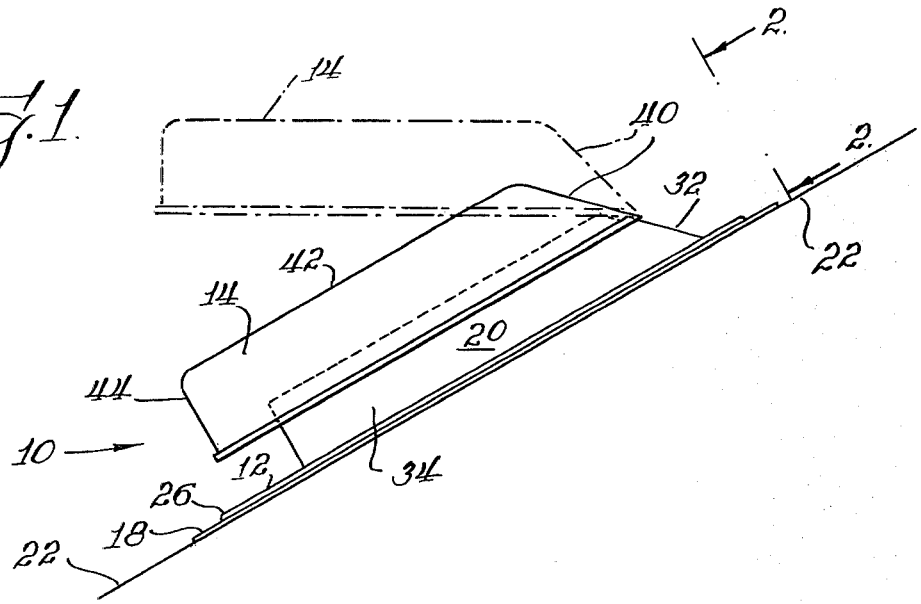
FIG. 1 is a side view of the louver of the invention installed on a roof, showing the steps of installation of the cover onto the base.
Figure 4:
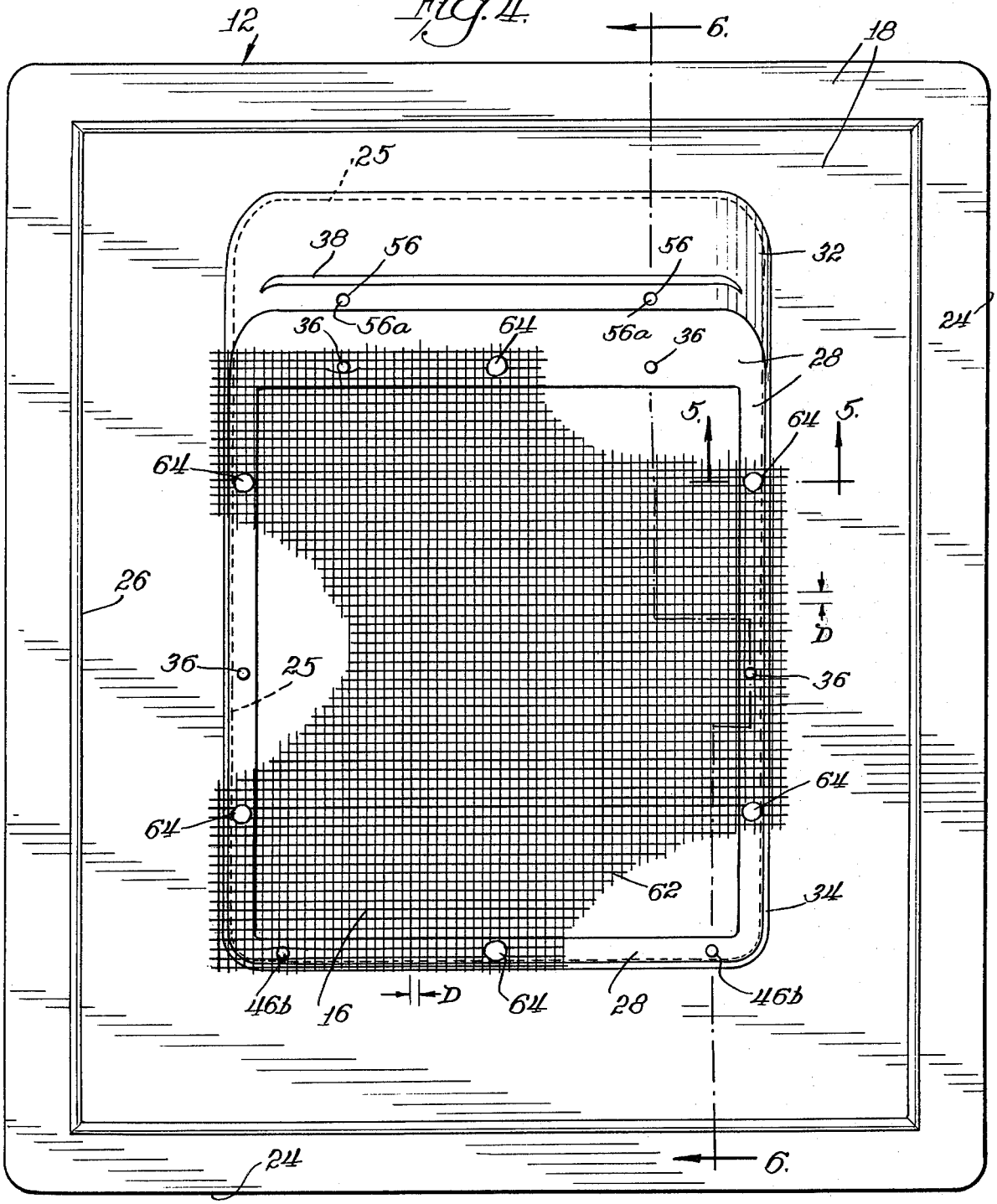
FIG. 4 is a top plan view of the base.

Referring to FIGS. 1 and 4, the roof ventilating louver 10 includes a base 12, cover 14 and screen 16. The base 12 includes a rectangular mounting panel 18 and a four-sided collar 20. The mounting panel 18 serves as flashing for the louver 10 and rests on the roof 22. The peripheral portion 24 of the rectangular mounting panel 18 may easily be installed under overlapping shingles (not shown). A ridge 26 may be provided in the mounting panel 18 near the peripheral portion 24 to provide a convenient guide for cutting the overlapping shingles. In addition, the ridge 26 is an aid in preventing water from entering underneath the shingles.

The four-sided collar 20 projects upwardly from the periphery 25 of a central rectangular opening 30 defined by the mounting panel 18. A flat rim 28 extends inwardly around the upper edge 27 (FIG. 6) of the four-sided collar 20. Together, the periphery 25 of the central rectangular opening 30, collar 20 and rim 28 define a ventilation opening.

The collar 20 is composed of two sections, sloping side 32 and collar upright portion 34 (FIGS. 1, 2, 4, 5, 6 and 7). Sloping side 32 slopes upwardly and inwardly from the periphery 25 of central rectangular opening 30. The upright portion 34 of collar 20, contiguous with sloping side 32, is perpendicular to the mounting panel 18.

Figure 3:
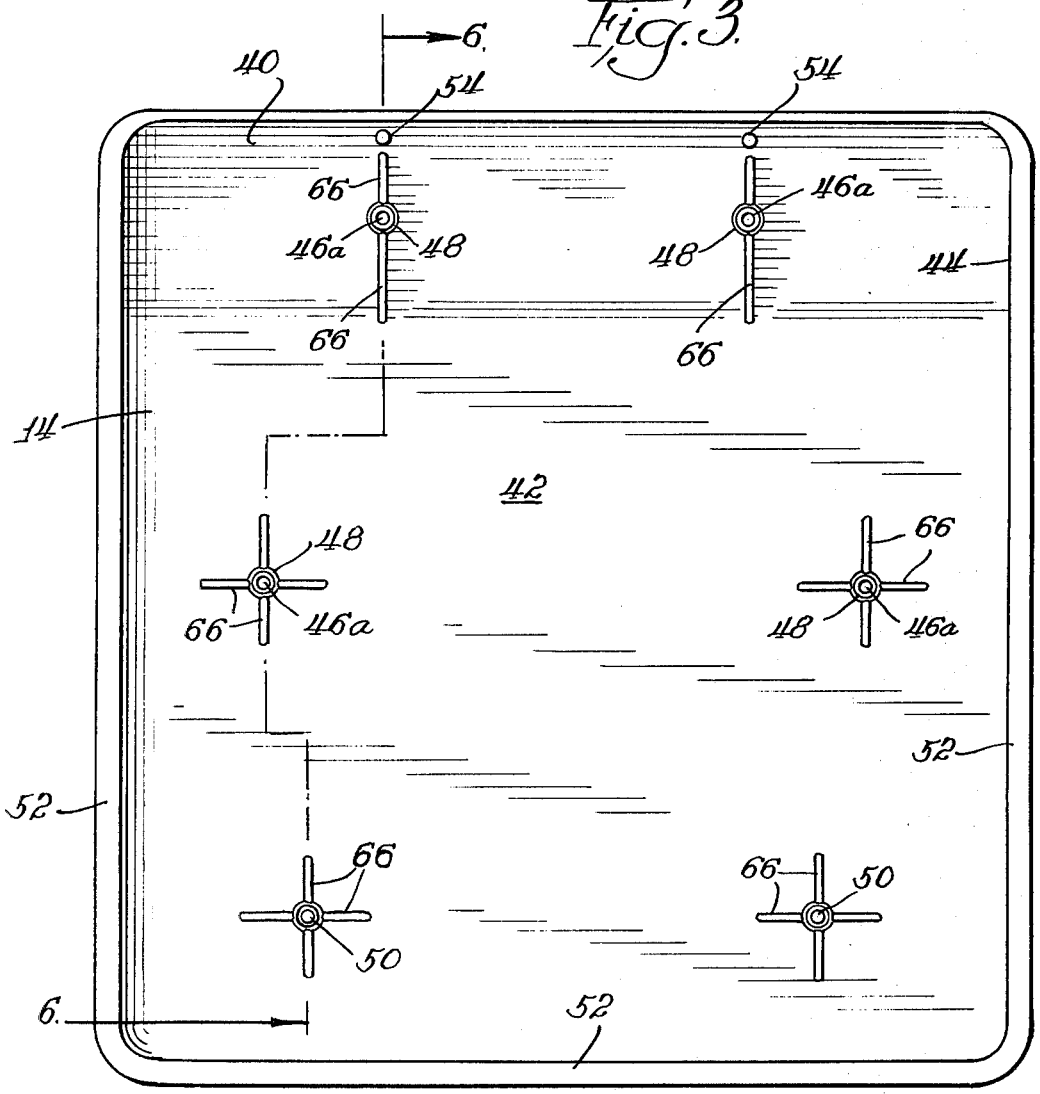
FIG. 3 is a bottom plan view of the cover.
Figures 6, 7:
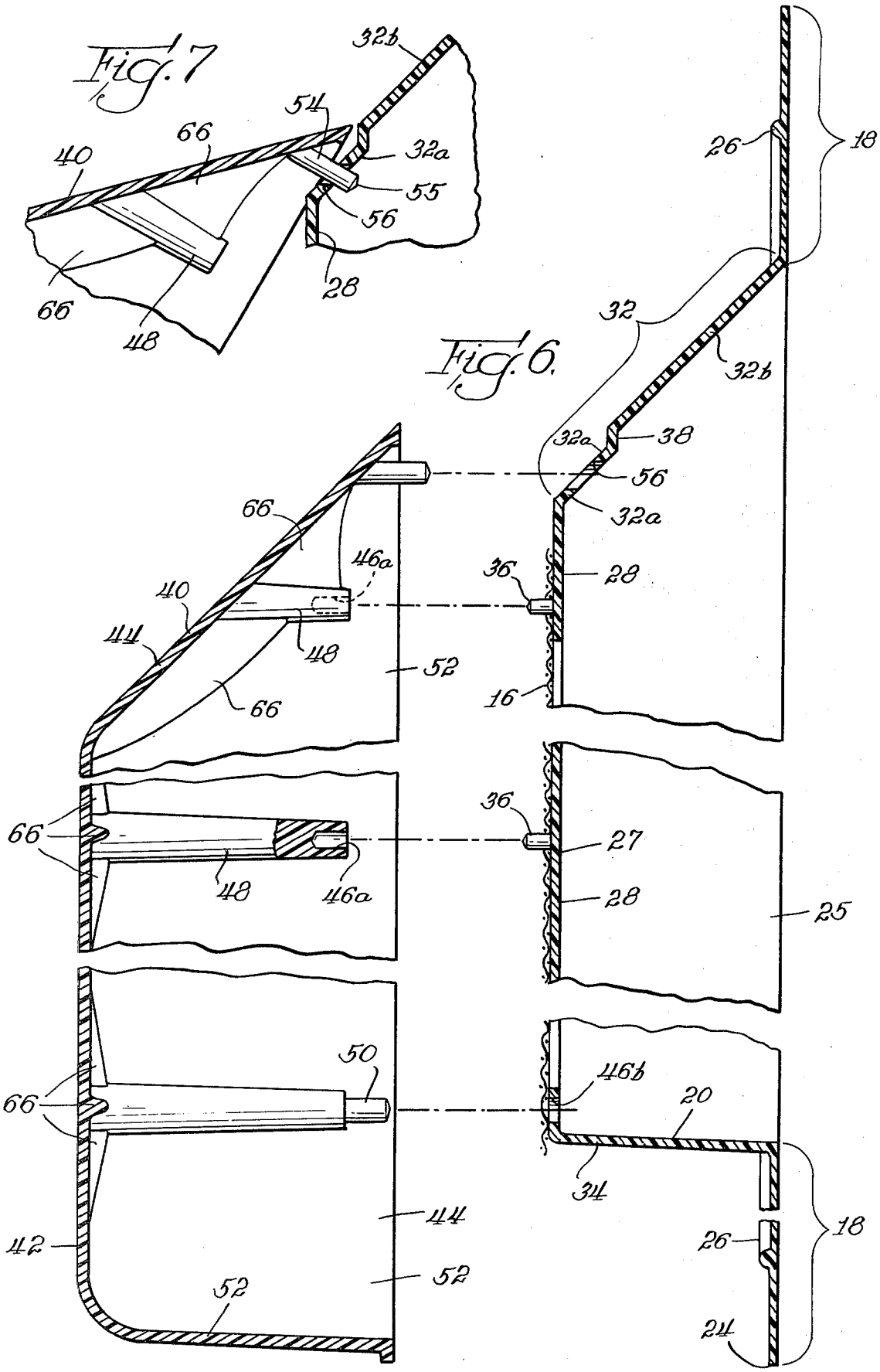
FIG. 6 is an exploded view in cross section of the louver, taken at line 6—6 of FIG. 3 and FIG. 4.
FIG. 7 is a detail view in cross section, illustrating the unique hinge action of the cover with the base.

As best shown in FIGS. 3 and 6, the cover 14 includes a flat rectangular top 42 and a four-sided skirt flange 44 depending from the top 42. The base 12 (FIG. 4) includes a plurality of upwardly projecting fastener posts 36 disposed about the rim 28 to engage and secure the cover 14. The upwardly projecting fastener posts 36 engage fastener openings 46*a* in the cover as defined by extension posts 48 extending downwardly from top 42. Similarily, downwardly projecting fastener posts 50 project downwardly from the top 42 to engage fastener openings 46*b* disposed about the rim 28. Upwardly and downwardly projecting fastener posts 36, 50 are closely fitted to fastener openings 46*a*, 46*b* respectively, providing means for securing cover 14 to base 12 but also allowing the removal of the cover 14 for inspection of the screen 16. The downwardly projecting fastener posts 50 and extension posts 48 are supported by support grids 66.

Just as the collar 20 is divided into sloping side 32 and collar upright portion 34, the flange 44 surrounding the top 42 is divided into inclined side 40 and flange upright portion 52 contiguous with the upper slope portion 40. When cover 14 is secured to the base 12, flange upright portion 52 of the four-sided skirt flange 44 overlaps collar upright portion 34, maintaining a sufficient spacing between collar upright portion 34 and flange upright portion 52 so as to permit free flow of air out the ventilation opening and through the spacing. The flange 44 protects the ventilation opening from the environment while allowing for this free passage of air. It is not necessary that flange upright portion 52 be perpendicular to top 42 or mounting panel 18 but, as with the sloping side 32 of collar 20 on base 12, it is imperative that inclined side 40 includes that portion of the skirt flange 44 which faces the roof apex.

Figure 2:
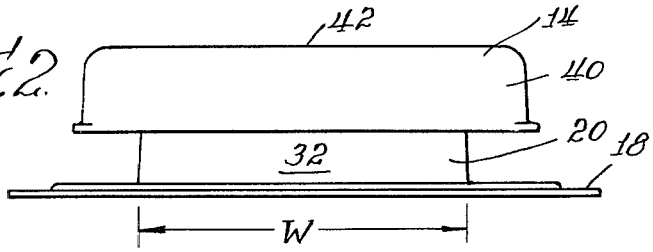
FIG. 2 is an end view of the louver taken at line 2—2 of FIG. 1.

As seen in FIGS. 1 and 2, when the cover 14 is installed on the base 12, that part of inclined side 40 corresponding to the width W of sloping side 32 overlaps and engages the upper portion 32*a* of the sloping side 32. Thus, inclined side 40 and lower portion 32*b* of the sloping side 32 form a substantially continuous sloping surface from the mounting panel 18 to the top 42 of the cover 14. Because of the continuous surface, very little air escapes the ventilation opening around sloping side 32. The sloping side 32 and inclined side 40 reduce the tendency of snow and ice to collect in the location on roof 22 immediately above louver 10. In addition, because louver 10 is closed on the roof-apex side, melting ice and snow cannot enter the ventilation opening.

In the preferred embodiment, the upper portion 32*a*, on which rests the inclined side 40, is physically separated from the lower portion 32*b* by a step 38 extending across sloping side 32 and substantially parallel to the rim 28 and mounting panel 18. By employing step 38, the upper portion 32*a* is indented from lower portion 32*b*, thus facilitating the smooth interface between lower portion 32*b* of sloping side 32 and the inclined side 40. The step 38 thus improves appearance although it is not necessary to the invention.

The unique construction of sloping side 32 and inclined side 40 makes possible the easy, time saving installation of the cover 14 onto base 12 through the use of pilot posts 54 and pilot openings 56 (FIGS. 3, 4, 6 and 7). In the preferred embodiment, two laterally spaced pilot openings 56 are made in the upper portion 32*a* of sloping side 32, the openings being perpendicular to the mounting panel 18. Thus, the surface area (not shown) of the pilot openings 56 at the sloping side 32 is greater than the cross-sectional area 56*a* of the pilot openings 56. The surface area of the pilot openings 56 at the sloping side 32 are elliptical in configuration when the cross-sectional area 56*a* is circular. Pilot posts 54 project downwardly from the lower portion of inclined side 40 at locations coaxial with the pilot openings 56 in the assembled louver 10, such that the pilot posts 54 engage the pilot openings 56. When the cover 14 is secured to base 12, the pilot openings 56 and pilot posts 54 create a close fit sufficient to help maintain the cover 14 in its secured position to base 12. However, the larger surface areas of the pilot openings 56 relative to the cross-sectional areas 56*a* permit easy orientation between pilot posts 54 and pilot openings 56.

Because of this larger surface area the pilot posts 54 need not engage pilot openings 56 directly above the openings such as illustrated in the exploded view of FIG. 6. Instead, pilot posts 54 may engage pilot openings 56 at an angle, as seen in FIG. 7, to create a temporary hinge between cover 14 and base 12. Once the pilot posts 54 are positioned in the pilot openings 56, as seen in FIG. 7, the cover 14 may simply be lowered as shown in FIG. 1. The pilot posts 54 and pilot openings 56 serve as orienting means for the cover with respect to the base, providing assured orientation so that the upwardly and downwardly projecting fastener posts 36, 50 and fastener openings 46*a*,46*b* respectively, are accurately aligned. The installer then merely presses down on top 42 of cover 14 to secure the cover 14 in place.

Two corresponding pilot posts 54 and openings 56 guarantee accurate alignment of the cover and base. The hinge action between the pilot openings 56 and pilot posts 54 virtually eliminates lateral motion between the cover and base. Because the pilot openings 56 and pilot posts 54 are disposed on the sloping and inclined sides 32, 40 the cover may be placed against the base at an angle, as shown in phantom in FIG. 1, thereby allowing the installer to see what he is doing while aligning pilot posts 54 with pilot openings 56. In the preferred embodiment each pilot post has a pointed tip 55 which aids alignment.

Figure 5:
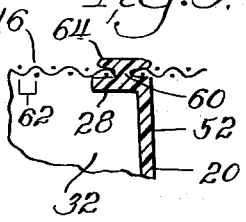
FIG. 5 is a detail view in cross section of a portion of the base taken at line 5—5 of FIG. 4.

Another feature of the present invention is the means for securing screen 16 to base 12. As shown in FIGS. 4 and 5, screen posts 60, similar to upwardly projecting fastener posts 36, are disposed about the rim 28. The screen 16 includes mesh openings 62 which are substantially the same size as upwardly projecting fastener posts 36 and screen posts 60. This close fit between the mesh openings 62 and fastener and screen posts 36, 60 helps to secure the screen 16 to rim 28. However, the screen 16 is permanently secured to the base by partially melting the screen posts 60. As best seen in FIG. 5, partial melting of the screen posts 60 forms enlarged heads 64 thereon, thereby fastening the screen 16 between the rim 28 and the enlarged heads 64 of screen posts 60. Such a fastening method avoids the use of rivets or other more costly fastening means.

The partial melting of screen posts 60 is possible because the design features of the invention permit construction of the base and cover from a thermoplastic material such as ABS. To prolong life, the ABS may include an ultraviolet light inhibitor to protect against exposure to sunlight.

Preformed post holes in the screen 16 need not be made to fasten the screen to the base 12. The screen pattern and size of the mesh openings 62 are carefully coordinated with the placement of the upwardly and downwardly projecting fastener posts 36, 50 and the screen posts 60. Thus, each upwardly projecting fastener post 36, screen post 60, and fastener opening 46*b* on the rim is disposed a distance from the other posts 36, 60 and fastener openings 46*b*, (as measured along the rim 28), which corresponds to some integer multiplier of the mesh width D of the mesh openings 62. Such placement assures that each fastener post 36, 50 and screen post 60 will easily fit through a mesh opening 62. The distance between each upwardly projecting fastener post 36, screen post 60 and fastener opening 46*b* need not be the same, just as long as each distance is some integer multiplier of the mesh width D.

The above described design features provide an improved design for a roof ventilating louver. Cost of manufacture and installation time are decreased. Installation is made easier. Most importantly, the unique slope feature prevents drippage through the ventilation opening and permits hinge action between cover and base which provides for their assured orientation, as well as permitting quick and effective periodic inspections of the screen and ventilation opening.

I claim:

1. In a roof ventilating louver comprising a base comprised of a rectangular mounting panel having central rectangular opening therein and a four-sided collar rising from the periphery of said opening and a cover mounted upon said base in spaced relation to said collar, said cover comprising a flat rectangular top covering and extending beyond said aperture and a four-sided skirt flange depending from the periphery of said top part way to said mounting panel, and means for securing said cover to said base, the improvement wherein one side of said collar is formed to slope inwardly and the corresponding side of said skirt flange is similarly inclined and engages said sloping side of said collar to form a substantially continuous sloping surface from said base mounting panel to said top of said cover, and means for properly orienting said cover with respect to said base when assembling said louver, said orienting means comprising a pair of laterally spaced pilot holes in the upper portion of said sloping side of said collar and a pair of pilot posts extending downwardly from the lower portion of said inclined side of said skirt flange at locations coaxial with said pilot holes in the assembled louver.

2. The roof ventilating louver as in claim 1, including a flat rim extending around the upper edge of said four-sided collar, a plurality of screen posts projecting upwardly from said flat rim, and a screen having a plurality of mesh openings, said screen resting on said flat rim and extending across said central rectangular opening defined by said four-sided collar and said rectangular mounting panel, wherein said mesh openings have widths not substantially less than the width of said screen posts such that said screen fits over and engages said screen posts and onto said rim, said screen being secured by said screen posts.

3. The roof ventilating louver as in claim 1, including a flat rim extending around the upper edge of said four sided collar, wherein said securing means comprises a plurality of upwardly projecting fastener posts disposed about said rim, a plurality of downwardly projecting fastener posts projecting from said top of said cover, a plurality of extension posts projecting downwardly from said top of said cover and defining fastener openings corresponding with said upwardly projecting fastener posts, and a plurality of fastener openings disposed about said rim of said base corresponding to said downwardly projecting fastener posts, said upwardly and downwardly projecting fastener posts being coaxial with said corresponding cover and base fastener openings in the assembled louver.

4. The roof ventilating louver as in claim 3, further including a screen having a plurality of mesh openings, said screen resting upon said rim and extending over said central rectangular opening, said mesh openings of said screen having widths not substantially less than the width of said upwardly and downwardly projecting fastener posts such that said screen fits about said posts.

5. The roof ventilating louver as in claim 3, further including a plurality of screen posts projecting upwardly from said rim, and a screen having a plurality of mesh openings, said screen resting on said rim and extending over said central rectangular opening, said mesh openings of said screen having widths not substantially less than the width of said screen posts such that said screen fits over and engages said screen posts and onto said rim, said screen being secured by said screen posts, the width of said upwardly and downwardly projecting fastener posts such that said mesh openings fit thereabout.

6. The roof ventilating louver as in claim 5, wherein said screen posts and said upwardly and downwardly projecting fastener posts are each mutually disposed a distance measured along said rim which equals some integer multiplier of said screen mesh opening width.

7. The roof ventilating louver as in claim 1, constructed of ABS plastic, including an ultraviolet light inhibitor.

8. The roof ventilating louver as in claim 1 wherein each of said pilot posts includes a pointed tip to facilitate cooperation of said pilot posts with said pilot holes.

* * * * *